United States Patent [19]

Swenson

[11] 4,178,058

[45] Dec. 11, 1979

[54] TEST PROBE FOR TELEPHONE WIRE CONNECTOR

[76] Inventor: John H. Swenson, Big Lake, Minn. 55309

[21] Appl. No.: 913,581

[22] Filed: Jun. 8, 1978

[51] Int. Cl.[2] ..... H01R 13/38; H01R 13/54

[52] U.S. Cl. ..... 339/108 TP; 324/72.5; 179/1 PC

[58] Field of Search ..... 324/72.5, 148 P; 179/1 PC, 175, 175.1, 175.3 P; 339/108 TP, 97 T

[56] References Cited

U.S. PATENT DOCUMENTS

| | | | |
|---|---|---|---|
| 2,020,402 | 10/1935 | Edwards et al. | 324/72.5 |
| 2,445,667 | 7/1948 | Fuglie | 324/72.5 |
| 2,476,115 | 7/1949 | Runbaken | 324/72.5 |
| 2,479,186 | 8/1949 | Simkins | 324/72.5 |
| 2,639,318 | 5/1973 | Des Roches | 324/72.5 |
| 2,702,892 | 2/1955 | Youger | 324/72.5 |
| 3,378,807 | 4/1968 | Glover | 339/108 TP |

*Primary Examiner*—Rudolph V. Rolinec
*Assistant Examiner*—Walter E. Snow
*Attorney, Agent, or Firm*—Burd, Braddock & Bartz

[57] ABSTRACT

All of the pairs of insulated telephone lines in a long line cable are spliced at the same intervals and the splices are situated in junction boxes where linemen can have access to both junctions of each pair. Each line splice consists of a metallic splice bar forced into electrical contact with each of the parallel, spaced-apart ends of the line, the splice bar and both line ends being encased in a splice body of plastic, dielectric material which is provided with an access opening through to the splice bar between the spaced apart lines. A continuity check probe of the invention includes a metallic hook-shape rod having a short finger of shape and dimension to pass through the body access opening to contact the splice bar when a parallel, spaced-apart long finger of the rod lies in parallel, adjacent relation to the splice body. The long finger of the probe rod carries a compression coil spring acting between the outer end of the long finger and the insulating body to hold the short rod finger firmly against the splice bar. The spliced line can then be tested by fastening the test instrument to the hook-shape rod.

1 Claim, 3 Drawing Figures

TEST PROBE FOR TELEPHONE WIRE CONNECTOR

BACKGROUND OF THE INVENTION

This invention has relation to a means for checking the continuity of spliced pairs of telephone lines without the necessity of destroying the splices and resplicing the lines after the testing has been accomplished.

A preliminary search was conducted on the invention, and was reported on Sept. 28, 1977. The references located are not believed to be particularly pertinent to the invention. The reference patents cited on this search are:

U.S. Pat. No. 2,020,402, granted to Edwards, et al. in November of 1935;

U.S. Pat. No. 2,445,667, granted to Fuglie in July of 1948;

U.S. Pat. No. 2,476,115, granted to Runbaken in July of 1949;

U.S. Pat. No. 2,479,186, granted to Simkins in August of 1949; and

U.S. Pat. No. 2,639,318, granted to Des Roches in May of 1973.

The applicant and those in privy with him know of no prior art which anticipates the invention herein.

The present method for checking the continuity in a pair of telephone lines leading to a specific home telephone installation for example, where the service has been interrupted, is to proceed to a junction box full of spliced pairs halfway between the malfunctioning telephone and the central telephone office, locate the particular pair of lines extending to that telephone by means of the color coding on the lines, clip off the splice immediately adjacent the insulating plastic body, and apply the test instrument to the clipped off lines. If a dial tone back to the central station is heard, then the lineman knows that the trouble is from his test point out toward the telephone. He will then go to a junction box halfway between the one he has just tested and the telephone and will repeat the procedure. First, however, he must reapply a splice to the free ends of each of the lines of the tested pair at his original test site. This shortens up the available wire in that line at that junction point, and if several tests must be made with the same pair, eventually the lines will not be long enough to be spliced, and extra wire must be spliced in, adding to the confusion and tangle of spliced pairs at the junction box.

Since two new splices must be made on each of the pairs of lines each time a test is made, the cost of the splices including the insulating splice bodies and metallic splice bars is considerable.

To alleviate the problems existing, the structure of the present invention were developed.

BRIEF SUMMARY OF INVENTION

Splices in electrical lines in communication systems, for example, in long telephone lines, are made at periodic intervals and these splices are made to coincide with the location of junction boxes where linemen checking the continuity of the lines can have access to them. Customarily these splices are made by inserting the two ends of the single insulated line to be spliced into a body member of insulating material, forcing a metallic splice bar onto each of the ends to be spliced to cut through the insulation and establish electrical continuity between those ends. This is done as an insulating splice bar plug is forced into the body member to form a splice body of insulating material to encapsulate the splice. In the splices in use today, an opening is provided through the splice body between the parallel, spaced-apart spliced ends of the line to the metallic splice bar.

The continuity check probe of the invention includes a hook-shape rod having a short finger of electrical conducting material of size and configuration to extend through the opening in the splice body between the spaced apart ends of the spliced line and into contact with the splice bar while a parallel, spaced-apart, long finger of the rod is located in parallel adjacent relationship to the splice body. A spring means associated with the finger of the hook-shape rod is situated to act on the end of the long finger and on the splice body to constantly maintain this short finger in firm electrical contact with the splice bar.

Test instruments can then be electrically attached to the hook-shape rod of each probe of a pair to perform the continuity checks.

IN THE DRAWINGS

DESCRIPTION OF PREFERRED EMBODIMENT

Figures 1, 2, 3:
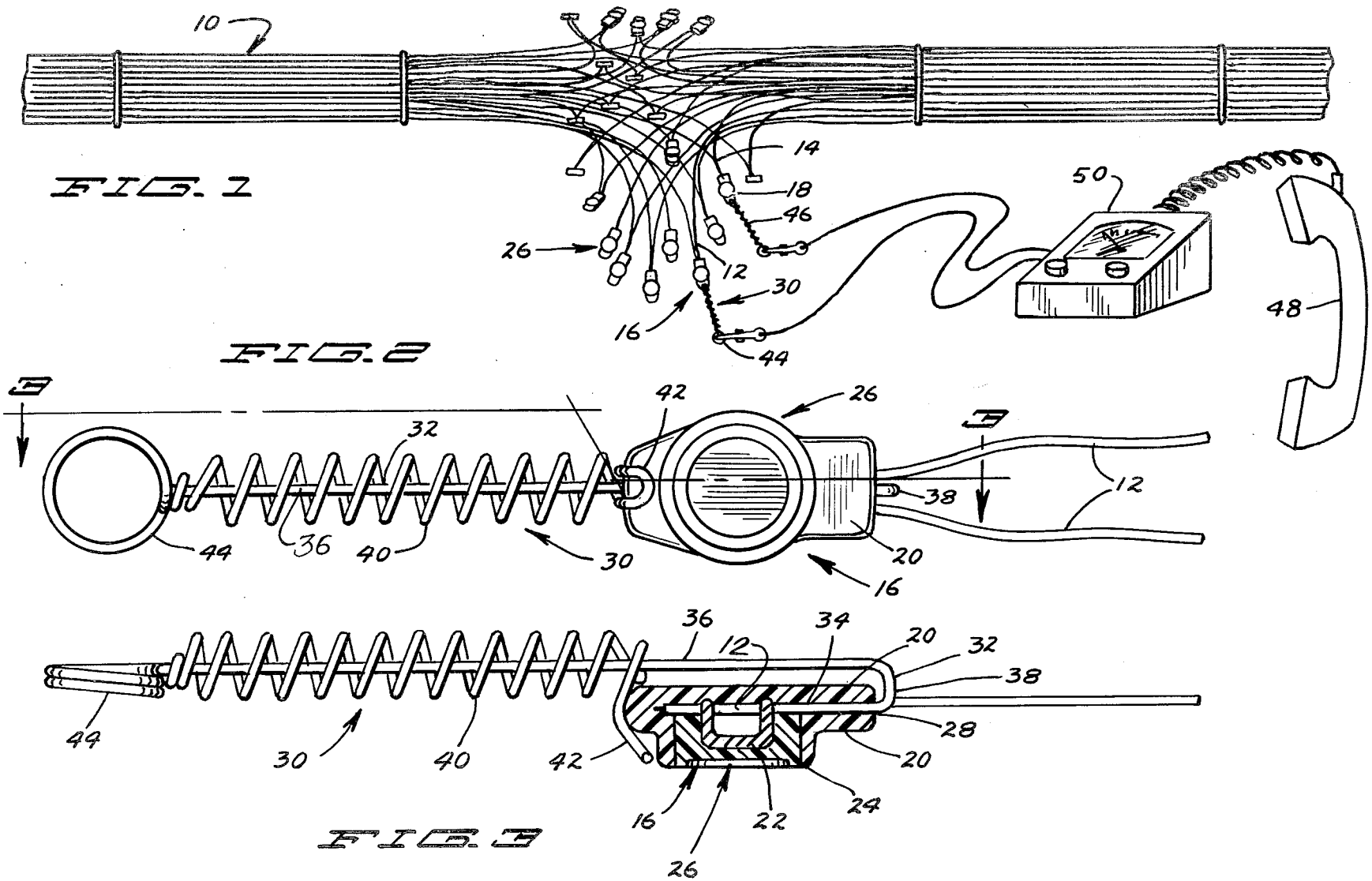
FIG. 1 is an elevational view of a section of a long telephone transmission cable showing a plurality of spliced pairs of telephone lines and showing a spliced pair electrically connected to a test meter and to a test telephone instrument through the instrumentality of two continuity check probes of the present invention.
FIG. 2 is an enlarged top plan view of one spliced telephone line, the insulating splice body which encloses the splice, and showing the relationship of the continuity check probe of the invention to the splice body when it is installed for use therewith.
FIG. 3 is a side elevational and sectional view taken on the line 3—3 in FIG. 2.

A long line telephone cable 10 includes a number of pairs of telephone lines to individual households, for example, a pair of lines can include a first insulated telephone line 12 and a second line 14. Splices 16 and 18 connect the adjacent ends of line 12 and of line 14, respectively. These splices and all of the other splices shown in FIG. 1 will be assembled in a junction box where they can be shielded from the weather and from access to others, but where they can be worked on when necessary by telephone linemen. The junction box is not shown.

Referring to FIGS. 2 and 3, the splice includes an insulating body member 20 provided with an opening 28 therethrough. The two ends of the insulated telephone line 12 are situated in roughly parallel, spaced-apart relationship to each other and are inserted into the body member 20 where they remain in spaced apart relationship. A U-shaped, elongated, metallic splice bar 22 has sharpened portions designed to be pushed onto the two ends of the line 12 in body member 20 to establish electrical contact between the line ends through the splice bar. An insulating body member plug 24 is forced against the splice bar 22 to cause it to make and maintain electrical contact with each end of line 12.

The body member 20 and the body member plug 24 together form a splice body 26 of insulating material. The material can be thermoplastic, for example. Such a splice is sold by 3M Company as a wire connector under the trademark SCOTCH LOCK. The Bell System furnishes an equivalent device known as a "B-connector". Other forms of wire connectors could also be used as long as they include a body provided with an opening such as the opening 28 through which the ends of the line or wire 12 extend.

All of the foregoing is part of the prior art, and deals with the environment in which the invention operates.

A first continuity check probe 30 of the invention includes a hook-shape rod 32 having a short finger 34 and a parallel, spaced-apart long finger 36 connected to the short finger by an intermediate U-shape rod portion 38. A compression coil spring 40 is in surrounding relationship to the long finger 36 of the rod 32 and is provided with an integral splice body retaining arm 42 extending outwardly from the long finger 36. A circular handle 44 is provided at the outer end of the long finger 36, and the outer end of the compression spring 40 is limited in its outward movement by this handle.

In use, the spliced pairs which are to be checked are located from the color coding on the lines themselves. This color coding is not shown in the drawings, but it is assumed that line 14 and line 12 go to one particular telephone installation and are the pair which are to be checked for continuity.

The short finger 34 of the hook-shape rod 32 of the continuity check probe is inserted into the opening 28 in the splice body 26 to position the outer end of the short finger in electrical contact with the U-shape, elongated, metallic splice bar 22 as best seen in FIG. 3. The splice bar body retaining arm 42 is positioned as seen in FIGS. 2 and 3, to cause the compression coil spring 40 to exert a pressure between the handle 44 of the long finger 36 and the insulating splice body 26, thus to hold the short finger 34 firmly in electrical contact with the splice bar, and, consequently, with each of the ends of the line 12.

A second continuity check probe 46 will be similarly installed on splice 18 to bring it into electrical contact with both ends of the line 14.

The one or more test instruments such as a lineman's test phone 48 and/or an electrical test meter 50 can be attached between the handle 44 of first probe 30 and to the corresponding handle of the second continuity check probe 46.

Typically, this hookup will first be made at a junction box halfway between the telephone which is malfunctioning and the central office. If the lineman hears a dial tone, and the test telephone works normally, he knows that his difficulty is between that junction box and the installed telephone. If he does not get a dial tone, then he knows his trouble is between this test point and the central office. If the indication is that the trouble is toward the central office, he will go to a junction box halfway between this check point and the central office and will repeat the procedure.

If the indications are that the continuity is okay at this point, he will go halfway toward the telephone installation, and repeat the check.

In this manner he will locate the trouble.

In leaving each junction box after making the continuity check, the lineman simply pushes the handle 44 toward the splice body and removes the short finger 34 from the splice body 26. No replacing of the splice is needed because the splice is still intact.

The embodiments of the invention in which an exclusive property or privilege is claimed are defined as follows:

1. An electrical test probe for use with two parallel, spaced-apart, electrically spliced together, insulated electrical lines having the spliced portion encapsulated in a splice body of insulating material, the splice body being provided with an opening from an electrically conducting portion of said splice within the body to position outside the body between the two electrical lines; said probe including:

A. a single, integral, hook-shape rod of electrically conducting material, said rod having:
   (1) a short finger,
   (2) a long finger,
   (3) an intermediate finger portion electrically connecting a first end of each of the long and short fingers to each other to be in parallel, spaced-apart, adjacent physical relationship to each other, and
   (4) a handle member situated at a second end of said long finger, said rod being of size and configuration to cause a second end of said short finger to contact said electrically conducting portion of the splice when the short finger is inserted into the opening in the splice body between the two electrical lines and the long finger is situated in adjacent, parallel relationship to the splice body; and B. a compression coil spring surrounding said long finger, said spring having an integral splice body retaining arm extending outwardly from an end of said spring opposite said rod handle, said spring and retaining arm bearing on said handle and on said splice body to firmly hold said second end of said short finger in contact with an electrically conducting portion of the splice within the splice body.

* * * * *